US005368086A

United States Patent [19]

Kloskowski

[11] Patent Number: 5,368,086

[45] Date of Patent: Nov. 29, 1994

[54] METHOD FOR MAKING A CERAMIC MOLD

[75] Inventor: Alan B. Kloskowski, Elmhurst, Ill.

[73] Assignee: Sarcol, Inc., Chicago, Ill.

[21] Appl. No.: 970,215

[22] Filed: Nov. 2, 1992

[51] Int. Cl.[5] ..... B22C 9/00; B22C 9/04

[52] U.S. Cl. ..... 164/33; 164/35; 164/516

[58] Field of Search ..... 164/24, 33, 35, 516, 164/518, 519

[56] References Cited

U.S. PATENT DOCUMENTS

| | | | |
|---|---|---|---|
| 2,748,435 | 6/1956 | Hackett . | |
| 2,795,022 | 6/1957 | Shaw . | |
| 2,811,760 | 11/1957 | Shaw . | |
| 2,837,798 | 6/1958 | Bleuenstein . | |
| 2,931,081 | 4/1960 | Dunlop . | |
| 3,022,555 | 2/1962 | Shaw . | |
| 3,172,176 | 3/1965 | Greenwood . | |
| 3,511,302 | 5/1970 | Barron . | |
| 3,692,086 | 9/1972 | Michelon | 164/516 |
| 4,050,500 | 9/1977 | Steinbacher . | |

OTHER PUBLICATIONS

Literature provided by Stauffer entitled "Composite Ceramic Mold" (3 pages; incomplete; undated).

Literature provided by Stauffer entitled "Ceramic Mold" (5 pages; undated).

*Primary Examiner*—Kuang Y. Lin

*Attorney, Agent, or Firm*—Willian Brinks Hofer Gilson & Lione

[57] ABSTRACT

A new method for producing a composite ceramic mold for production of metal castings is disclosed. The composite mold is comprised of a backing layer and a facing layer. The backing layer is formed by pouring a mixture of a suitable refractory, a gelling agent, and a binder about an oversized pattern. After the backing layer hardens, it is fired and then baked. The facing layer is then formed integrally with the backing layer by pouring a mixture of comminuted highly refractory material, a gelling agent, and a binder between the oversized backing layer and a dimensionally-correct pattern. After the facing layer hardens, it is fired and then baked.

40 Claims, 2 Drawing Sheets

METHOD FOR MAKING A CERAMIC MOLD

FIELD OF THE INVENTION

The present invention relates to a method for producing ceramic molds for production of metal castings, and more particularly relates to a new method of producing an improved composite ceramic mold consisting of a backing layer and a facing layer formed integrally therewith of a comminuted highly refractory material.

BACKGROUND OF THE INVENTION

Methods of producing ceramic molds for production of metal castings are well known. The earliest method known to applicant is that disclosed in Shaw, U.S. Pat. No. 2,795,022, and commonly referred to as the "Shaw process." In the Shaw process, the mold is fabricated entirely from a single composition consisting of a comminuted highly refractory material, a binder, water, and a gelling accelerator. The binder typically comprises a lower alkyl silicate, such as ethyl silicate. These ingredients are mixed to form a homogenous paste, and then poured about a pattern and permitted to gel. Immediately after gelling, the mold is removed from the pattern and then fired, i.e. ignited in an open-air furnace to remove the alcohol or any other burnable volatiles formed by the hydrolysis of the binder and thereby "fix" the mold dimensions. According to the '022 patent, when combustion of the volatiles ceases, the mold can either be at once used for casting metal or it can be further heated in a suitable furnace.

A similar method is disclosed in U.S. Pat. No. 2,811,760 to C. Shaw. That method is directed to the use of molding mixtures containing binders that, unlike the binder disclosed in the '022 patent, do not yield combustible volatiles (such as alcohol) upon setting. Such molds are also "fixed" by firing because the heat of the fire causes the evaporable substances in the mold to quickly evaporate and escape through the external mold surfaces.

While the Shaw process is purportedly suitable for some purposes, it has been found that molds fabricated of a single layer of highly refractory material are unsuitable for most purposes, especially where low tolerances are desired. This is believed to be for the following reasons. After the mold composition gels, it is fired. The purpose of firing the mold is to remove at least a substantial amount of the volatiles or other evaporables in the mold composition to "stiffen" or "fix" the mold so that it subsequently can be baked or, alternatively, immediately used for casting metal. The purpose of the baking step is to remove any residual volatiles or evaporables remaining in the mold. This permanently fixes the mold dimensions so they do not change during the casting stage, wherein the mold is subjected to the extremely intense heat of the molten metal.

The amount of volatiles or evaporables that are removed from the mold during the firing stage is, to some degree, related to the porosity of the mold composition which, in turn, is related to the particle size of the refractory used. If the particle size of the refractory material is too small and the mold composition is thus too dense, only the volatiles or evaporables at or near the surface of the mold will be released or combusted during the firing stage. The mold, being comprised of a highly refractory material, is an excellent insulator onto itself. Thus, the interior region of the mold will remain relatively cool and the volatiles and evaporables therein will neither escape nor combust. Thus, when the mold subsequently is baked or, alternatively, immediately used for casting metal, the volatiles or evaporables remaining in the interior region of the mold will undergo rapid combustion or gas phase transformation due to the intense heat of the furnace or molten metal. Because of the density of the mold, however, the resultant gases will be unable to either escape to the atmosphere, or combust, as quickly as they are generated. As a result, the mold will twist or distort and, in some instances, explode. Naturally, the thicker the mold, the more untoward the effects.

If, on the other hand, the particle size of the refractory material is too large and the mold composition is thus too porous, two problems occur. First, the mold will unlikely be able to withstand the heat of the molten metal. Second, even if that problem is overcome, smooth surface finishes of the metal casting are difficult to achieve. The porous, and thus rough, surface of the mold will result in a correspondingly rough surface of the metal casting. This may also affect the dimensional tolerance of the metal casting and render it unacceptable for uses requiring low tolerances. In addition, such a casting will need further machining and finishing procedures, which are labor-intensive and expensive.

Moreover, determining and obtaining the optimum particle size refractory material for a given mold is a difficult task. First, the shape, size, and configuration of a mold varies with the metal casting to be manufactured. Each customer's needs are different. Second, even if the optimum particle size could be determined for a particular mold size and configuration, commercially obtainable refractory materials have varying average particle sizes even among same grades. Thus, it is difficult to duplicate a mold exactly.

The problems of twisting and warping encountered in the Shaw process have been expressly recognized by Shaw himself in a later patent, U.S. Pat. No. 3,022,555. In that patent, Shaw disclosed a method which was proclaimed to be a solution to the twisting and warping of the molds of the original '022 Shaw process. In the '555 method, fragments or crushings of a finished, highly refractory mold made in accordance with the original Shaw process are incorporated into the slurry from which the new mold is made. In the alternative, a slab or undersized pattern can be made according to the original Shaw process, and then the highly refractory slurry is poured about the slab to create the final mold. The fragments or slabs constitute about 10–50% of the mass of the mold and about 10–50% of the volume of the mold. In either case, after the slurry gels or hardens, the mold is fired to remove the volatiles.

It has been determined, however, that the '555 method does not work well. In short, such a mold is weak and unstable and the heat of the molten metal causes the mold to break apart. In practice, the slurry does not adhere well to the crushings or slabs as its gels. In addition, whereas the gelled slurry expands when it is subsequently fired or baked, the crushings or slabs do not expand. As a result, separations occur between the surfaces of the hardened slurry and the surfaces of the crushings or slabs.

Other methods intended to improve, replace, or economize the Shaw process have also been devised. For instance, in the above-mentioned Shaw '760 patent, a method of constructing a mold of two ceramic layers—an "inexpensive" backing layer and a highly refractory facing layer—is disclosed. In this alternate method of the '760 patent, there is first produced a highly refractory facing layer by pouring an ethyl silicate base slurry over the face of the pattern and permitting it to gel. Immediately thereafter, a slurry containing an "inexpensive" refractory is poured against the facing layer to create a supportive backing layer. Immediately after the backing layer gels, the entire two-layer mold is placed in a pre-heated furnace to rapidly remove the evaporable substances.

In U.S. Pat. No. 2,931,081 to Dunlop, the backing layer is poured first and it is treated with carbon dioxide gas for hardening. The hardened backing layer is then placed over the actual pattern, and the space between the backing layer and the pattern is filled with the highly refractory mixture to form the facing layer. After the facing layer gels, the composite mold is fired to burn off the alcohol.

In both the method of the Shaw '760 patent and the method of the Dunlop '081 patent, the highly refractory facing layer and the "inexpensive" backing layer of the mold are formed and hardened, or gelled, before any firing or baking of either layer occurs.

The apparent benefit of these two-layered molds is having a very porous backing layer through which volatiles and evaporables can readily escape during both the firing and baking stages and, at the same time, having a very fine facing layer which resists the heat of the molten metal and provides a smooth casting surface. Because the facing layer is thin, the gas-capture problems associated with thick, single layer molds are avoided.

However, these two-layered molds still have not proven satisfactory for either production of metal castings requiring very low tolerances or applications where those low tolerances need to be consistent among different molds made from the same pattern. For instance, in the two-layer mold method such as that disclosed in the Shaw '760 patent, it has been learned that the best tolerance that can be achieved for a mold having a dimension up to 5 inches is ±5 thousandths inch. For each inch of mold cavity dimension above 5 inches, and additional 1 thousandths inch tolerance is added. For example, a mold having a cavity depth of 8 inches would have an achievable tolerance of ±8 thousandths inch and a mold having a cavity depth of 20 inches would have an achievable tolerance of ±20 thousandths inch. For many modern applications, even the best achievable ±5 thousandths inch tolerance is unacceptable.

Moreover, achieving the same tolerance among two molds made from the same pattern is extremely difficult and, as a practical matter, can only be attained randomly. Because the distortion that occurs in the mold during the baking or casting stages varies with the density, or porosity, of the mold composition, as well as other factors, each mold will have slightly different final dimensions. In practice, all of the parameters involved in manufacturing a mold simply cannot be duplicated exactly from mold to mold. For instance, for all practical purposes, it is very difficult to obtain commercially two volumes of refractory material having identical particle size distributions, even if the average particle size is the same. It is also very difficult to obtain, as between two molds, the exact amount and strength of each ingredient (accelerator and gelling agent), or the same gelling times and firing and baking temperatures and times.

It is now believed that these problems inherent in the prior art two-layer mold fabrication methods are due to the following reasons. When the composite two-layered mold is baked, the porous backing layer expands. This expansion of the material is both desirable and undesirable. Expansion of the backing material is desirable because the mold must be sufficiently porous to permit gases released from the molten metal to escape through the mold thickness during casting. Expansion of the backing material during baking is undesirable because it changes the dimensions and thus affects the tolerances of the mold. Moreover, because of the interaction between the backing layer and the facing layer, the expansion of the backing layer causes distortions and irregularities in the mold. Unless the backing and facing layers exhibit nearly identical thermal expansion characteristics, those layers will "fight" each other. Moreover, in some instances, the facing layer resists expansion during baking altogether.

Thus, heretofore, for low-tolerance applications, it has oftentimes been necessary to resort to either extensive finishing procedures of the metal castings after they are pulled from the molds, or, manufacturing the metal castings by machining rather than molding. The main and obvious disadvantage of these procedures is that they are labor-intensive and thus, as compared to pure molding procedures, are extremely expensive.

Other problems also are inherent in these prior art two-layer mold fabrication methods. Consider a mold fabricated by first pouring a backing composition about an oversized pattern, permitting the backing layer to gel, and then pouring the facing composition in the gap between the gelled backing layer and the dimensionally-correct pattern. In these circumstances, it is very difficult to obtain a facing layer that is both of sufficient thickness to resist the heat of the molten metal and which adequately adheres to the backing layer. This is because there is no reliable way to judge the optimal gelling time of the facing layer. The optimal gelling time depends on a variety of factors, such as average particle size, volumes of refractory material, gelling agent, accelerator, and water, mixing time, etc., all of which tend to differ with each slurry prepared. If the facing layer is not permitted to gel for a long enough period of time, it will run after the two-layered mold is removed from the pattern. The facing layer will thus develop thinned areas incapable of resisting the heat of the molten metal. As a result, when the molten metal is poured into the mold, the backing layer will melt and create slag in the surface of the casting. This, in turn, will further cause changes in the shape of the mold and thus affect tolerances. In contrast, if the facing layer is permitted to gel for too long a period of time, it will not adhere well to the backing layer. These problems are encountered even when the facing layer is formed first.

Thus, a method for producing ceramic molds that have very low tolerances, as well as consistency of those low tolerances among different molds made from the same pattern, and that avoids these discussed problems of the prior art methods, is desirable.

SUMMARY OF THE INVENTION

The present invention is a method for making a composite ceramic mold and the mold made therefrom. The method comprises first forming a backing layer comprised of a refractory material suitable for metal casting applications, a binder, and a gelling agent. Once the backing layer gels, it is fired. After firing, the backing layer is baked. When the baked backing layer is cooled, its cavity is scored. A facing layer, comprised of a comminuted, highly refractory material suitable for metal casting applications, a binder, and a gelling agent, is then formed integrally with the fired and baked backing layer. Once the facing layer gels, the composite mold is fired and then baked.

One of the principal features of the present invention is to provide a method of producing a ceramic mold for production of metal castings that is inexpensive.

Another feature of the present invention is to provide a method of producing a ceramic mold where very low dimensional tolerances is achieved.

Yet another feature of the present invention is to provide a method of producing a ceramic mold for production of metal castings wherein dimensional consistency between molds produced from the same pattern can be repeatedly realized.

Another feature of the present invention is to provide a method of producing a ceramic mold for production of metal castings wherein the adherence of the facing layer to the backing layer is not highly dependent on the gelling time of the facing layer.

Another feature of the present invention is to provide a method of producing a ceramic mold for production of metal castings wherein, during the firing and baking stages, the backing layer and the facing layer do not have opposed dimensional changes that cause distortions in the mold.

Yet another feature of the present invention is to provide a method of producing a ceramic mold wherein dimensional consistency of molds produced from the same pattern is not highly sensitive to small differences in the amounts and ratios of ingredient volumes, strength of ingredients, particle sizes, gelling times, and baking and firing times and temperatures.

To these and other ends, the inventive process for producing a ceramic mold comprises forming a backing layer by pouring a mixture of a suitable refractory, a binder, and a gelling agent about an oversized pattern and permitting the backing layer to gel or harden. Upon hardening, the backing layer is stripped from the oversized pattern and fired to remove a substantial amount of the volatiles or evaporables therein. The fired backing layer is then baked to remove any residual volatiles or evaporables, and then cooled. The cavity of the cooled backing layer is then scored. Next, the backing layer is placed over the actual-dimension pattern, and a facing layer is formed by pouring a mixture of a comminuted, highly refractory material, a binder, and a gelling agent, between the backing layer and the pattern. The facing layer is permitted to gel or harden, and then the entire mold is stripped from the pattern and is fired to remove a substantial amount of the volatiles or evaporables from the facing layer. The fired composite mold is then baked to complete the removal of residual volatiles or evaporables from the facing layer.

The foregoing features and advantages of the present invention will be further understood upon consideration of the following detailed description of the invention taken in conjunction with the accompanying drawings, in which:

DETAILED DESCRIPTION OF THE PRESENTLY PREFERRED EMBODIMENT

The general methods of fabricating ceramic molds for production of metal castings are discussed in the above-mentioned prior art patents. The types of refractories, binders, and gelling agents useful in such methods are also discussed therein and are well known in the industry. U.S. Pat. No. 2,795,022 to Shaw and U.S. Pat. No. 2,811,760 to C. Shaw are incorporated herein by reference.

Figure 3:
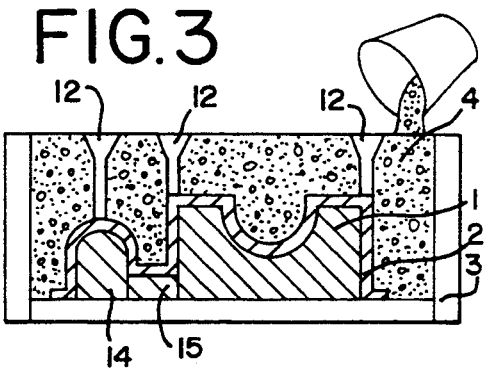
FIG. 3 is similar to that of FIG. 2 and illustrates the pouring of a backing material over the temporary spacer and pattern to create a backing layer.
Figure 4:
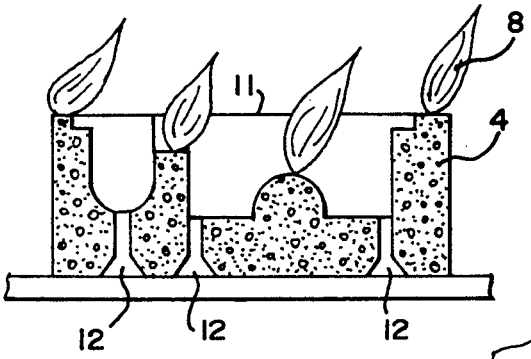
FIG. 4 illustrates the backing layer of FIG. 3 stripped from the pattern and being fired.
Figure 5:
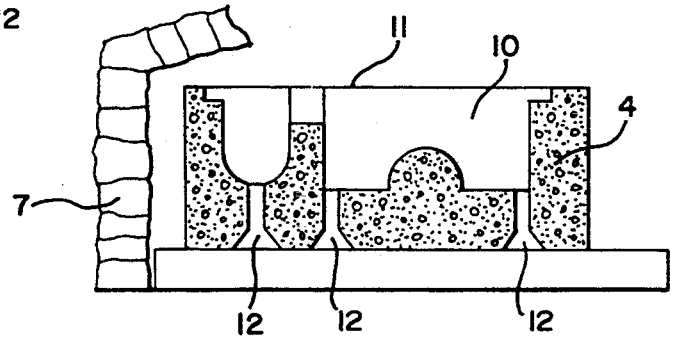
FIG. 5 illustrates the backing layer of FIG. 4 being baked.
Figure 6:
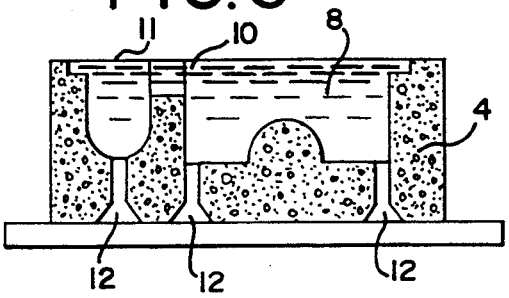
FIG. 6 illustrates the backing layer of FIG. 5 wherein the cavity has been scored.
Figure 7:
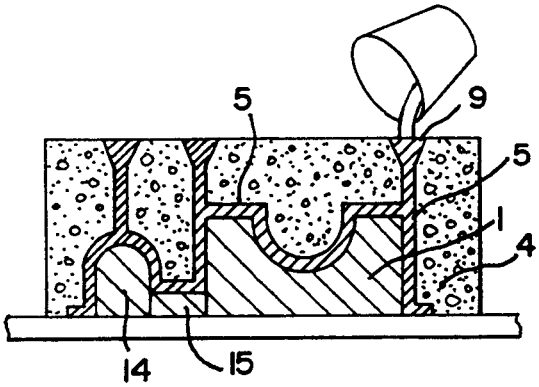
FIG. 7 illustrates the backing layer of FIG. 6 placed over the pattern with the temporary spacer removed, and further illustrates the pouring of a facing material between the backing layer and the pattern to create a composite two-layer mold.
Figure 8:
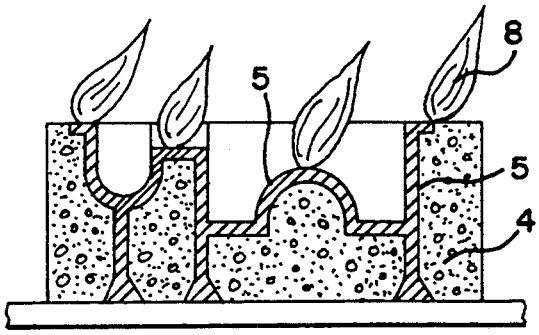
FIG. 8 illustrates the composite mold of FIG. 7 stripped from the pattern and being fired.
Figure 9:
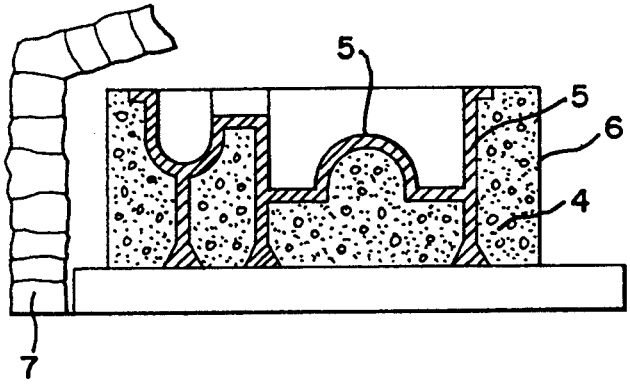
FIG. 9 illustrates the composite mold of FIG. 8 being baked.
Figure 10:
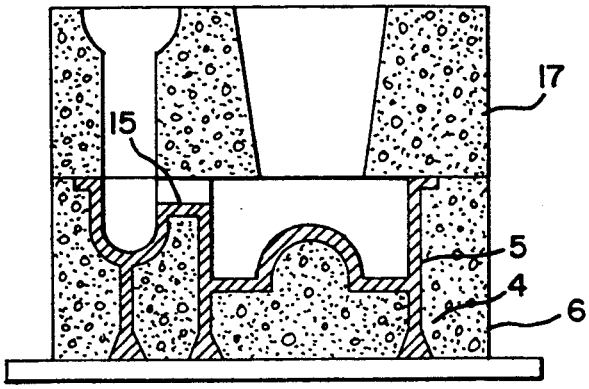
FIG. 10. is a cross-sectional view of the composite two-layer mold fabricated according to the method of the present invention.

In the preferred embodiment of this invention, a ceramic mold for production of metal castings 6 is made by first producing a backing layer 4 which comprises pouring a mixture of a suitable refractory, a binder, and a gelling agent about a pattern 1 having a spacing layer 2 and permitting the backing layer to gel or harden. See FIG. 3. Upon hardening, the backing layer 4 is stripped from the pattern 1 and spacing layer 2 and fired in an open-air furnace 8, as shown in FIG. 4. The fired backing layer 4 is then baked in a suitable furnace 7, as shown in FIG. 5, and then cooled. The surface 10 of the backing layer which defines the cavity 11 of the backing layer is then scored or scratched. See FIG. 6. The purpose of this is to facilitate adhesion of the facing layer to the backing layer, as hereafter described. The cooled backing layer 4 is then placed or anchored over pattern 1, and a facing layer 5 is formed by pouring a mixture of a highly refractory material, a binder, and a gelling agent, between the backing layer 4 and the pattern 1. See FIG. 7. The facing layer 5 is permitted to gel or harden, and then the entire mold 6 consisting of backing layer 4 and facing layer 5 is stripped from the pattern 1 and is fired, as shown in FIG. 8. The fired composite two-layer mold 6 is then baked, as shown in FIG. 9, resulting in a final composite two-layer mold 6 suitable for production of metal castings (see FIG. 10). As shown in FIG. 10, a cope 17 is utilized along with the mold in a well known manner for pouring molten metal.

Figure 1:
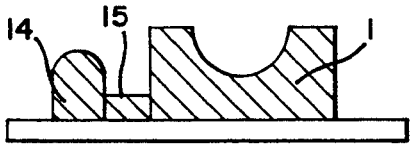
FIG. 1 is a cross-sectional view of a pattern and gating.
Figure 2:
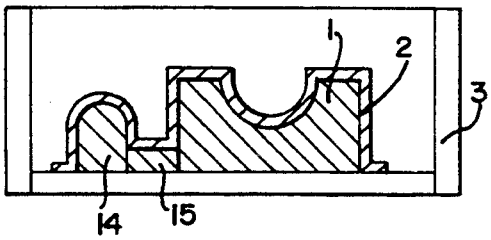
FIG. 2 illustrates the pattern and gating of FIG. 1 to which is applied a temporary spacer.

It is noted that the pattern 1 includes an appendage 14 that defines a gating 15 in the final mold. See FIGS. 1 and 10. A four-walled box 3 is positioned around the pattern 1 to define the outside dimensions of the mold. See FIGS. 2 and 3. Dowel rods (not shown), projecting vertically are positioned at various points along the pattern surface to define channels 12 through which the facing layer composition is poured. See FIGS. 3 and 7.

Figure 2A:
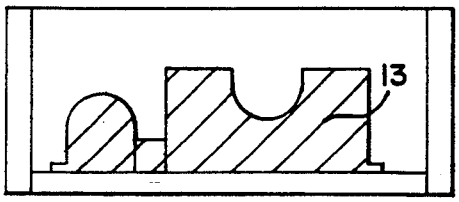
FIG. 2*a* illustrates an oversized pattern that can be used in place of the pattern and temporary spacer of FIG. 2.

As mentioned, the backing layer is formed by pouring the backing layer composition about the pattern 1 and a spacing layer 2. The pattern 1 is an actual-dimension pattern. Thus, the pattern 1 and spacing layer 2 define an oversized pattern. The spacing layer 2 is typically comprised of clay, wax or some other suitable moldable substance which can be removed from the pattern 1 after the backing layer is stripped therefrom. Alternatively, in place of the pattern 1 and spacing layer 2, a unitary oversized pattern 13 can be used. See FIG. 2*a*. The oversized pattern defines the cavity 11 and the cavity surface 10 of the backing layer.

The cavity surface 10 is scored using stone, sand paper, or any other suitable abrasive. The scoring, or scratches, are preferably longitudinal and having random size and spacing.

The types of metals and alloys that are typically cast in ceramic molds generally include steel, nickel, copper, iron, beryllium, beryllium-copper, aluminum, and other metals.

The types of refractories that are suitable for casting a given metal or alloy are numerous, and may be used in various combinations. Factors to consider are the heat of the molten metal and the reactivity of the refractory to the metal. In a given application, a suitable refractory or refractory mixture is one that will both withstand the heat of the molten metal and be metal non-reactive. Likewise, the average particle size and particle size distribution of the chosen suitable refractory will depend on a number of factors, such as whether the refractory is being used in the backing or the facing layer, the heat of the molten metal, the desired surface finish, etc.

Refractories that can be used in the backing layer include sodium silicate, inexpensive refractories, and/or sand. A recommended backup layer refractory is Mulgrain TM 47, grade 3000, manufactured by C-E Minerals, King of Prussia, Pa. Mulgrain TM 47 is a calcinated mullite consisting largely of alumina and silica, and having a chemical composition by weight of approximately 47.8% aluminum oxide ($Al_2O_3$), 49.1% silicon dioxide ($SiO_2$), 1.85% titanium dioxide ($TiO_2$), 0.95% iron oxide ($Fe_2O_3$), 0.04% calcium oxide (CaO), 0.08% magnesium oxide (MgO), 0.09% sodium oxide ($Na_2O$), 0.09% potassium oxide ($K_20$), and 0.09% phosphorous pentaoxide ($P_2O_5$).

The particle size distribution of the Mulgrain TM 47, grade 3000, is, by weight, approximately 0–2% larger than 8 mesh, 30–40% between 8 mesh and 30 mesh, 18–30% between 30 mesh and 200 mesh, and 35–45% finer than 200 mesh.

High-temperature-resistant refractories commonly used in the facing layer include 30–325 mesh grades of zircon, fused silica, aluminum silicates (such as mullite, sillimanite, and calcinated kyanite), or other high temperature and metal non-reactive ceramic materials, with the majority of the refractory mix being 100 mesh or finer. A recommended facing refractory is Zircon 50/50, manufactured by American Minerals, Rosiclaire, Ill. Zircon 50/50 contains by weight 50% zircon sand, B grade, and 50% zircon flour, 325 mesh. The zircon sand, B grade, has a chemical composition by weight of approximately 66.0% zirconium dioxide ($ZrO_2$), 0.07–0.10% iron oxide ($Fe_20_3$), 0.07–0.14% titanium dioxide ($TiO_2$), 0.6–0.8% aluminum oxide ($Al_2O_3$), 32.0–33.0% combined silicon dioxide ($SiO_2$), and 0.1% free silicon dioxide ($SiO_2$).

The particle size distribution of the zircon sand, B grade, is, by weight, approximately 0.1% greater than 50 mesh, 9.5% between 50 mesh and 70 mesh, 22.0% between 70 mesh and 100 mesh, 34.5% between 100 mesh and 140 mesh, 28.4% between 140 mesh and 200 mesh, 5.0% between 200 mesh and 270 mesh, and 0.5% finer than 270 mesh.

The zircon flour, 325 mesh, has a chemical composition by weight of approximately 66.0% zirconium dioxide ($ZrO_2$), 0.07–0.14% titanium dioxide ($TiO_2$), 0.08–0.1% iron oxide ($Fe_2O_3$), 0.4–0.5% aluminum oxide ($Al_2O_3$), 32.0–33.0% combined silicon dioxide ($SiO_2$), and 0.1% free silicon dioxide. The particle size of the zircon flour, 325 mesh, is, by weight, approximately 95% finer than 325 mesh.

Another refractory that is useful as a facing layer material is Unicast Ceramic H/3, manufactured by Unicast Development Corporation, Pleasantville, N.Y. Unicast Ceramic H/3 is a member of the chemical family of amorphous silica/fused non-crystalline and blends thereof.

The binder can comprise either a lower alkyl silicate, an ethyl silicate, or an organic silicate, such as ethyl orthosilicate. Also, any alkyl silicate which yields an alcohol on hydrolysis and which alcohol is sufficiently volatile to burn when ignited can readily be used. Preferably the ethyl silicate comprises approximately 18.5–21.0% by weight silicon. A recommended binder is Silbond ® H-5, which is an ethyl polysilicate, manufactured by Stauffer Chemical Company, Specialty Chemical Division; Westport, Conn. Silbond ® H-5 has a silicon content of a minimum of 19.5% by weight and is normally about 20% by weight. Silbond ® H-5 reacts with water and aqueous acids forming ethanol and silicon dioxide ($SiO_2$).

Other binders that can be used are Unibond P/19 or P/22 sold by Unicast Development Corporation, Pleasantville, N.Y. Unibond P/19 has a silicon content of approximately 18.5–19.5% by weight, and Unibond P/22 has a silicon content of approximately 19.5–21.00% by weight.

The gelling agent or accelerator comprises an aqueous acid, such as a dilute ammonium hydroxide (e.g. 25 volume parts of reagent ammonium hydroxide (18–30% $NH_3$) in 200 volume parts of distilled water).

The invention will now be illustrated with an example.

EXAMPLE 1

A composite ceramic mold for production of metal castings was fabricated in accordance with the preferred embodiment of the present invention. The following ingredients and volumes were used:

| | Volume (ml) |
|---|---|
| Backing layer composition: | |
| Refractory, Mulgrain TM 47, grade 3000 | (see below) |
| Binder, Silbond ® H-5 | 26,000 |
| Gelling agent, aqua ammonia | 3,300 |
| Facing layer composition: | |
| Refractory, Zircon 50/50 | (see below) |
| Binder, | 2,400 |

-continued

| | Volume (ml) |
|---|---|
| Silbond ® H-5 Gelling Agent, aqua ammonia | 240 |

The mold had an overall length of 27⅝ inch, an overall width of 17¾ inch, and an overall height of 10", which dimensions are the internal dimensions of a four-walled box placed around the pattern for defining the outside surfaces of the mold. The pattern was shaped so as to create a mold cavity thickness ranging from 3¼ inch to 4¾ inch. For purposes of fabricating the backing layer, a ⅜ inch layer of clay was applied to the surface of the pattern to form an oversized pattern.

The backing layer composition was formed by mixing 26,000 ml of binder with 3,300 ml of gelling agent, and then adding a sufficient amount of Mulgrain TM 47 refractory to provide a composition that was as thick as possible, but which was pourable. The backing layer composition was then immediately poured about the oversized pattern. Dowel rods were positioned to extend vertically and upward from the oversized pattern to create channels in the backup layer so as to enable the subsequent pouring of the facing layer.

The backing layer composition was permitted to gel for 4 minutes. The backing layer was then stripped from the oversized pattern, and the four-walled box and dowels were removed. The gelled backing layer was then fired in an open-air furnace for approximately 2 hours at 400°-500° F. After firing, the backing layer was placed in a furnace and baked for approximately 16 hours at about 1700° F. The backing layer was then permitted to cool. The cavity surface was then scored.

After cooling, the fired and baked backing layer was placed over the actual-dimension pattern (i.e. the clay layer was removed), leaving a gap of approximately ⅜ inch between the backing layer and the pattern.

The facing layer composition was then formed by mixing 2,400 ml of binder with 240 ml of gelling agent, and then adding a sufficient amount of Zircon 50/50 refractory to provide a composition that was as thick as possible, but sufficiently fluid to be pourable through the channels in the backup layer and to fill the gap between the backup layer and the pattern. The facing layer composition was then immediately poured through the channels in the backing layer until the gap between the backing layer and the pattern, as well as the channels, were filled.

The facing layer composition was permitted to gel for 2 minutes. The composite backing layer and facing layer was then stripped from the pattern and fired in an open-air furnace for approximately 30 minutes at 400°-500° F. After firing, the composite mold was placed in a furnace and baked for approximately 4 hours at about 1700° F. The composite mold was then permitted to cool.

S-7 tool steel was then cast in the composite mold. The molten steel had a temperature of 3100° F. The casting thus manufactured had a tolerance of ±3 thousandths inch.

It will be understood that different refractories, binders, and gelling agents may require different volume ratios, different gelling times, different firing temperatures and times, and different baking temperatures and times. Accounting for such variations is well within the expertise of a person of ordinary skill in the art.

It has been learned that by practice of the present invention, extremely low dimensional tolerances of the mold can be achieved. In the prior art method, the best obtainable tolerance for a mold cavity dimension up to 5 inches is ±5 thousandths inch. For each inch of mold cavity dimension above 5 inches, an additional 1 thousandths inch tolerance would be added. In the present invention, however, a tolerance of ±3 thousandths inch is consistently achieved for a mold having a cavity dimension up to 3 inches, and a tolerance of ±5 thousandths inch is achieved for a mold having a cavity dimension up to 20 inches. For cavity dimensions between 3 inches and 20 inches, tolerances ranging from ±3 thousandths inch to ±5 thousandths inch can be achieved, depending on the configuration of the mold cavity. In the example set forth above, for example, where the cavity depth ranged from 3¼ inch to 4¾ inch, a ±3 thousandths inch tolerance was achieved in that dimension. Had that mold been produced according to a prior art method, the best achievable tolerance would have been ±5 thousandths inch.

Such significantly lower achievable tolerances are extremely important for many modern applications. By virtue of being able to obtain such low tolerances utilizing the method of the present invention, other advantages are realized. For instance, metal castings do not need to be subsequently machined and finished to otherwise achieve these low tolerances. As a result, labor costs and time are saved. Also, the possibility of machining errors is avoided.

It is believed that the low tolerances achieved by utilizing the method of the present invention are due to the fact that the backing layer is fired and baked before the facing layer is formed integral therewith. By the time the facing layer is formed integral with the backing layer, the backing layer has already experienced any distortions that might occur during its firing and baking stages. By that point in the process, the dimensions of the backing layer are fixed. Thus, when the facing layer is subsequently fired and baked, it is not distorted by dimensional changes that would otherwise occur in the backing layer. Moreover, because the dimensions of the backing layer are fixed, the backing layer serves to resist any tendency of the facing layer to distort and the facing layer will retain the dimensions of the pattern.

A further advantage of the method of the present invention is the ability to consistently achieve the same tolerances for different molds fabricated from the same pattern. Unlike in the methods of the prior art, it has been found that under the method of the present invention, two different composite molds fabricated using the same pattern will have nearly identical final tolerances. This advantage of the present invention is important for applications where two or more metal castings are required, since a new mold is required for each metal casting.

It is believed that this advantage too stems from the fact that the backing layer is fixed before the facing layer is formed. Distortions that may occur in either of the backing or facing layers are dependent on small differences in the amounts and ratios of ingredient volumes, strength of ingredients, particle sizes, gelling times, and baking and firing times and temperatures, which small differences inevitably occur in each mold fabricated. Thus, in the prior art method, the dynamics between the distorting backing layer and the simultaneously distorting facing layer will likewise be different as between two molds fabricated from the same pattern.

In contrast, in the method of the present invention, regardless of any ingredient, volume, temperature, or time variances that might affect the degree or direction of distortion in the backing layer during the firing and baking stages, the backing layer is fixed before the facing layer is formed. Likewise, regardless of any ingredient, volume, temperature, or time variances that might affect the degree or direction of distortion in the facing layer during the firing and baking stages, the facing layer resists undergoing such distortions because of the dimensional support provided by the fixed backing layer.

Yet a further advantage of the method of the present invention is that successful mold production is not highly dependent upon the gelling time of the facing layer. As discussed above, in the prior art methods, it is difficult to determine the proper gelling time of the facing layer. As a result, two problems oftentimes occur: (1) the facing layer is stripped from the pattern prematurely and thus runs, causing thinned areas in the facing layer; or (2) the facing layer is stripped from the pattern too late and the facing layer fails to adhere well to the backing layer. Under the former circumstance, the facing layer is not able to withstand the heat of the molten metal and thus causes either a poor surface finish, and/or unacceptable tolerances. Moreover, under some casting conditions, the mold will fail altogether.

Under the present method, however, it has been found that the adherence of the facing layer to the backing layer is not highly dependent on the gelling time of the facing layer. That is, if the facing layer is permitted to gel for an abundant period of time, it will nonetheless adhere to the backing layer. Thus, premature stripping of the facing layer from the pattern, and subsequent running of the facing layer, can easily be avoided.

While the invention has been described with reference to a preferred embodiment, those skilled in this art will recognize modifications of structure, arrangement, composition and the like that can be made to the present invention, yet will still fall within the scope of the invention as hereafter claimed.

I claim:

1. A method for making a composite ceramic mold, comprising:

a) forming a backing layer composition comprised of a refractory material, a binder, and a gelling agent;
b) permitting said backing layer composition to gel to form a backing layer comprising a cavity having a cavity surface;
c) firing said backing layer;
d) baking said backing layer;
e) scoring said cavity surface;
f) forming a facing layer composition comprised of a highly refractory material, a binder, and a gelling agent;
g) permitting said facing layer composition to gel to form a facing layer integral with said fired and baked backing layer;
h) firing said integral facing and backing layers; and
i) baking said integral facing and backing layers.

2. The method of claim 1 wherein said refractory material used to form said backing layer composition comprises a material selected from the group consisting of sodium silicate, sand, calcinated mullite, and mixtures thereof.

3. The method of claim 1 wherein said highly refractory material used to form said facing layer composition comprises a material selected from the group consisting of zircon, zircon flour, fused silica, aluminum silicate, and mixtures thereof.

4. The method of claim 2 wherein said highly refractory material used to form said facing layer composition comprises a material selected from the group consisting of zircon, zircon flour, fused silica, aluminum silicate, and mixtures thereof.

5. The method of claim 1 wherein said binder comprises a silicate selected from the group consisting of lower alkyl silicates, ethyl silicates, organic silicates, and combinations thereof.

6. The method of claim 1 wherein said binder yields an alcohol on hydrolysis.

7. The method of claim 2 wherein said binder comprises a silicate selected from the group consisting of lower alkyl silicates, ethyl silicates, organic silicates, and combinations thereof.

8. The method of claim 3 wherein said binder comprises a silicate selected from the group consisting of lower alkyl silicates, ethyl silicates, organic silicates, and combinations thereof.

9. The method of claim 4 wherein said binder comprises a silicate selected from the group consisting of lower alkyl silicates, ethyl silicates, organic silicates, and combinations thereof.

10. The method of claim 1 wherein said gelling agent comprises an aqueous acid.

11. The method of claim 2 wherein said gelling agent comprises an aqueous acid.

12. The method of claim 3 wherein said gelling agent comprises an aqueous acid.

13. The method of claim 4 wherein said gelling agent comprises an aqueous acid.

14. The method of claim 5 wherein said gelling agent comprises an aqueous acid.

15. The method of claim 7 wherein said gelling agent comprises an aqueous acid.

16. The method of claim 8 wherein said gelling agent comprises an aqueous acid.

17. The method of claim 9 wherein said gelling agent comprises an aqueous acid.

18. The method of claim 5 wherein said ethyl silicate comprises approximately 18.5–21.0% by weight silicon.

19. The method of claim 7 wherein said ethyl silicate comprises approximately 18.5–21.0% by weight silicon.

20. The method of claim 8 wherein said ethyl silicate comprises approximately 18.5–21.0% by weight silicon.

21. The method of claim 9 wherein said ethyl silicate comprises approximately 18.5–21.0% by weight silicon.

22. The method of claim 3 wherein greater than about 50% by weight of the highly refractory material has a particle size of 100 mesh or finer.

23. The method of claim 4 wherein greater than about 50% by weight of the highly refractory material has a particle size of 100 mesh or finer.

24. The method of claim 9 wherein greater than about 50% by weight of the highly refractory material has a particle size of 100 mesh or finer.

25. The method of claim 22 wherein the particle sizes of said highly refractory material ranges from about 30–325 mesh.

26. The method of claim 23 wherein the particle sizes of said highly refractory material ranges from about 30–325 mesh.

27. The method of claim 24 wherein the particle sizes of said highly refractory material ranges from about 30–325 mesh.

28. The method of claim 2 wherein greater than about 50% by weight of the refractory material has a particle size of 200 mesh or coarser.

29. The method of claim 1 wherein said backing layer and said facing layer are fired at a temperature of about 400° to 500° F.

30. The method of claim 29 wherein said backing layer is fired for a period of about 2 hours and said integral facing and backing layers are fired for a period of about 30 minutes.

31. The method of claim 1 wherein said backing and said facing layers are baked at a temperature of about 1700° F.

32. The method of claim 31 wherein said backing layer is baked for a period of about 16 hours and said integral facing and backing layers are baked for a period of about 4 hours.

33. A method for making a composite ceramic mold, comprising:

a) combining a refractory material with a binder and a gelling agent, and forming a backing layer therefrom, said backing layer comprising a cavity having a cavity surface;
b) firing said backing layer;
c) baking said backing layer;
d) scoring said cavity surface;
e) combining a comminuted, highly refractory material suitable for metal casting with a binder and a gelling agent, and forming a facing layer therefrom integral with said fired and baked backing layer;
f) firing said integral facing and backing layers; and
g) baking said integral facing and backing layers.

34. A method for producing refractory molds which comprises:

a) preparing a first slurry comprising a refractory material, a binder, and a gelling accelerator;
b) pouring said first slurry over an oversized pattern, allowing the first slurry to gel, immediately separating the gelled mass of the first slurry from the oversized pattern, immediately thereafter firing the gelled mass of the first slurry and allowing it to burn until the flammables or evaporables are consumed, baking said fired gelled mass of the first slurry and scoring the surface of the resulting baked mass originally contacting said oversized pattern;
c) preparing a second slurry comprising a comminuted, highly refractory material, a binder, and a gelling accelerator;
d) pouring said second slurry between said scored surface of said fired and baked mass of the first slurry and an actual-dimension pattern, allowing the second slurry to gel and affix integral to said fired an baked mass of the first slurry, immediately separating the integral gelled mass of the second slurry and the fired and baked mass of the first slurry from the actual-dimension pattern, immediately thereafter firing the gelled mass of the second slurry and allowing it to burn until the flammables or evaporables are consumed, then baking said fired gelled mass of the second slurry.

35. The method of claim 34 wherein said oversized pattern comprises said actual-dimension pattern further comprising a spacing layer.

36. The method of claim 35 wherein said spacing layer comprises clay.

37. The method of claim 35 wherein said spacing layer comprises wax.

38. The method of claim 34 wherein said binder comprises a liquid lower alkyl silicate.

39. The method of producing an inexpensive, sturdy, highly refractory mold for metal casting including a backing body and a facing which comprises:

a) manufacturing said backing body from a mixture of refractory material, a binder, and a gelling agent, and pouring said mixture over an oversized pattern, permitting it to gel, immediately separating said gelled backing body from said oversized pattern, immediately thereafter igniting said backing body to burn any volatiles or evaporables in said backing body until said volatiles are consumed or said evaporables are released, baking said backing body and scoring the surface of the backing body originally contacting said over-sized pattern;
b) placing said backing body over an actual-dimension pattern thereby defining a space between said backing body and said actual-dimension pattern;
c) manufacturing said facing from a mixture of highly refractory material, a binder, and a gelling accelerator and filling said space between said backing body and said actual-dimension pattern with said mixture, permitting said mixture to gel and attach integral to said scored surface of said backing body, separating said actual-dimension pattern from said integral gelled facing and backing body, igniting said gelled facing to burn any volatiles or evaporables in said facing until said volatiles are consumed or said evaporables are released, and then baking said facing.

40. A method for making a composite ceramic mold comprised of a backing layer formed from a refractory material suitable for metal casting, a binder, and a gelling agent, and an integral facing layer formed from a comminuted, highly refractory material suitable for metal casting, a binder, and a gelling agent, wherein both the backing layer and the facing layer are fired and then baked, wherein the improvement comprises:

firing and baking said backing layer and scoring the baked backing layer on its surface that contacts the facing layer prior to forming integral therewith said facing layer, and then firing and baking said integral facing and backing layers.

* * * * *

UNITED STATES PATENT AND TRADEMARK OFFICE

CERTIFICATE OF CORRECTION

PATENT NO. : 5,368,086
DATED : November 29, 1994
INVENTOR(S) : Alan B. Kloskowski It is certified that error appears in the above-indentified patent and that said Letters Patent is hereby corrected as shown below:

In column 2, line 58, delete "its" and substitute --it--.

In column 3, line 43, delete "and" and substitute --an--.

In column 6, line 22, after "10" delete ".".

In column 8, line 33, delete ";" and substitute --,--.

In claim 34, line 22, delete "an" and substitute --and--.

Signed and Sealed this

Tenth Day of October, 1995

*Attest:*

Bruce Lehman

BRUCE LEHMAN

*Attesting Officer*

*Commissioner of Patents and Trademarks*